US006209820B1

(12) United States Patent
Golan et al.

(10) Patent No.: US 6,209,820 B1
(45) Date of Patent: Apr. 3, 2001

(54) SYSTEM FOR DESTROYING BALLISTIC MISSILES

(75) Inventors: Oded M. Golan, Kfar-Vradim; Hanan Rom, Misgav; Oded Yehezkely, Kiryat Tivaon, all of (IL)

(73) Assignee: Ministry of Defense Armament Development Authority, Haifa (IL)

( * ) Notice: Subject to any disclaimer, the term of this patent is extended or adjusted under 35 U.S.C. 154(b) by 0 days.

(21) Appl. No.: 09/356,986

(22) Filed: Jul. 19, 1999

(30) Foreign Application Priority Data

Jul. 22, 1998 (IL) ..... 125455

(51) Int. Cl.[7] ..... F41G 7/22
(52) U.S. Cl. ..... 244/3.15; 244/3.1; 244/3.24
(58) Field of Search ..... 244/3.1, 3.11, 244/3.14–3.19, 3.13, 3.24–3.29

(56) References Cited

U.S. PATENT DOCUMENTS

| | | | | |
|---|---|---|---|---|
| 3,883,091 | * | 5/1975 | Schaefer | 244/3.13 |
| 3,982,713 | * | 9/1976 | Martin | 244/3.1 |
| 4,522,356 | | 6/1985 | Lair et al. | 244/3.15 |
| 4,925,129 | * | 5/1990 | Salkeld et al. | 244/3.11 |
| 5,112,006 | * | 5/1992 | Palmer | 244/3.16 |
| 5,340,056 | * | 8/1994 | Guelman et al. | 244/3.16 |
| 5,464,174 | * | 11/1995 | Laures | 244/3.11 |
| 5,907,117 | | 5/1999 | Persson et al. | 89/1.11 |

FOREIGN PATENT DOCUMENTS

| | | |
|---|---|---|
| 69513 | 8/1983 | (IL) . |
| 111419 | 10/1994 | (IL) . |

* cited by examiner

*Primary Examiner*—Bernarr E. Gregory
(74) *Attorney, Agent, or Firm*—Fitch, Even, Tabin & Flannery

(57) ABSTRACT

A system for intercepting targets having predictable flight trajectory, the system comprising a platform carrying an interceptor missile which includes a seeker unit, propulsion system steering system and destruction capability system, all communicating with a processor device. The processor device is further coupled to a data link for communicating with the platform. In response to launching of the intercepting missile, the processor device controls the steering system and propulsion system for steering the missile in one of the following flight modes: (a) approach mode, wherein said intercepting missile closes on said target; (b) trajectory matching mode wherein the interceptor velocity vector is modified to bring the trajectory of the interceptor to match the predicted trajectory of the target so that the interceptor moves in the same direction as the target in a relatively small closing velocity with respect to the target; and (c) end game mode wherein the interceptor is maneuvered to a distance sufficiently close to the target whereby the target destruction capability can be activated efficiently.

18 Claims, 8 Drawing Sheets

SYSTEM FOR DESTROYING BALLISTIC MISSILES

FIELD OF THE INVENTION

The present invention is in the general field of intercepting targets having predictable flight trajectory, such as ballistic missiles (BM) that are launched towards a friendly territory.

BACKGROUND OF THE INVENTION

For convenience of explanation, the description below focuses on BM. The invention is by no means bound by this example and is aimed at intercepting any targets having predictable flight trajectory.

As is well known, interception of ballistic missiles is a difficult task. One of the major factors that hinders the interception mission is that the target BM develops after boost phase a relatively high flight velocity. This naturally results in a very high closing velocity of the intercepting platform (normally an intercepting missile) when approaching the target BM. The very high closing velocity imposes undue operational constraints on the various on-board and ground-based tracking and homing sub-systems that are associated with the intercepting platform, in order to accomplish successful destruction within an instant.

These constraints led to the development of a state-of-the-art on-board and ground based technologies (e.g. the joint U.S.—Israel ARROW system and the U.S. THAAD) in order to meet the operational specification of the intercepting mission.

Whilst the specified systems are a priori designed to perform the interception under given high velocity conditions, this does not mean that they will succeed in accomplishing the mission under ANY closing velocity conditions. Consider, for example, a first scenario in which a tactical ballistic missile (TBM) is launched from a first country to a second country. If the attacked state is protected, say, by the Arrow anti-TBM system, the latter will detect the launched missile by its early warning constituent, and in response to such an early warning, an Arrow missile will be launched so as to intercept the target TBM at a pre-planned interception zone under first closing velocity conditions.

Consider now a second scenario where the specified TBM is launched from a longer range, say from a third state. Naturally, the TBM will reach a higher velocity (as compared to the first scenario) when it approaches the interception zone, and considering that the flight velocity of the intercepting missile does not change as compared to the first scenario, the inevitable consequence is that the interception should now be implemented under second (higher) closing velocity constraints.

The varying closing velocity conditions impose yet another difficulty on systems such as the ARROW or THAAD to accomplish successful interception under any possible scenario. Put differently, the larger the closing velocity, the more strict are the timing constraints posed on the interceptor in order to accomplish successful interception. Likewise, under high closing velocity conditions, the accuracy operational specification of the sensors are increased.

It goes without saying that failure to give adequate answer to even one possible threat scenario, i.e. leakage of the target TBM to the friendly territory, will bring about dire consequence.

There is, accordingly, a need in the art to substantially simplify the complexity of the anti-BM system as compared to systems which operate under high and varying closing-velocity constraint.

SUMMARY OF THE INVENTION

The present invention is based on the understanding that the complexity of successfully intercepting BM is significantly reduced if the actual interception is performed at low closing velocity conditions.

To this end, and as shown in FIG. 1, the intercepting missile (1) is launched (launch encompasses in the context of the invention also drop or release) towards the BM (2) and approaches it in an essentially head-on trajectory (3) at a relatively high closing velocity. At a predetermined timing, the intercepting missile is steered to bend its flight trajectory (4) until it reaches a so called trajectory matching flight mode (5) where the intercepting missile is positioned ahead of the flight trajectory of the on-coming target. It should be noted that trajectory matching does not necessarily imply that the trajectories are in coincidence. Since now both the target and the intercepting missile fly in the same direction and further considering that the intercepting missile is planned to fly at a lower velocity than the target missile (in order for the latter to come close to the intercepting missile and thereby facilitate successful interception), it readily arises that the closing velocity is significantly reduced (as compared to intercepting conditions in hitherto known systems), allowing now for a relatively convenient end-game. In the end-game mode, the target is acquired and tracked by a seeker unit, and at a desired timing the processor that is fitted in the interceptor missile activates appropriate warhead so as to accomplish successful intercept.

Accordingly, the invention provides for a system for intercepting targets having predictable flight trajectory, comprising:

(i) A platform carrying at least one interceptor missile; the interceptor includes seeker unit, propulsion system steering system destruction capability system all communicating with a processor device; said processor device is further coupled to a data link for communicating at least with said platform;

(ii) in response to launching of said intercepting missile, the processor device is capable of controlling said steering system and propulsion system for steering said missile in at least the following flight modes:

(a) approach mode, wherein said intercepting missile closes on said target;

(b) trajectory matching mode wherein the interceptor velocity vector is modified to bring the trajectory of the interceptor to essentially match the predicted trajectory of the target so that the interceptor moves in the same direction as the target in a relatively small closing velocity with respect to the target;

(c) end game mode wherein the interceptor is maneuvered to a distance sufficiently close to the target whereby said target destruction capability can be activated efficiently.

The present invention further provides for an intercepting missile comprising:

(i) seeker unit, propulsion system steering system destruction capability system all communicating with a processor device; said processor device is further coupled to a data link for communicating at least with said platform;

(ii) in response to launching of said intercepting missile, the processor device is capable of controlling said steering system and propulsion system for steering said missile in at least the following flight modes:

(a) approach mode, wherein said intercepting missile closes on said target;

(b) trajectory matching mode wherein the interceptor velocity vector is modified to bring the trajectory of the interceptor to essentially match the predicted trajectory of the target so that the interceptor moves in the same direction as the target in a relatively small closing velocity with respect to the target;

(c) end game mode wherein the interceptor is maneuvered to a distance sufficiently close to the target whereby said target destruction capability can be activated efficiently.

The seeker unit may be any known per se active seeker, passive seeker, or combination thereof. The seeker unit is, obviously, capable of acquiring and possibly tracking targets.

The processor may be any known per se processing system which is realized as a single processor or plurality of processors located solely on-board and/or communicating with external processors of the system through said data link.

As will be explained below, the interceptor may be placed essentially ahead of target (and move slower with respect thereto), or placed essentially behind the target and move faster relative thereto.

BRIEF DESCRIPTION OF THE DRAWINGS

For a better understanding, the invention will now be described, by way of example only, with reference to the accompanying drawings, in which.

DESCRIPTION OF SPECIFIC EMBODIMENTS

Figure 1:
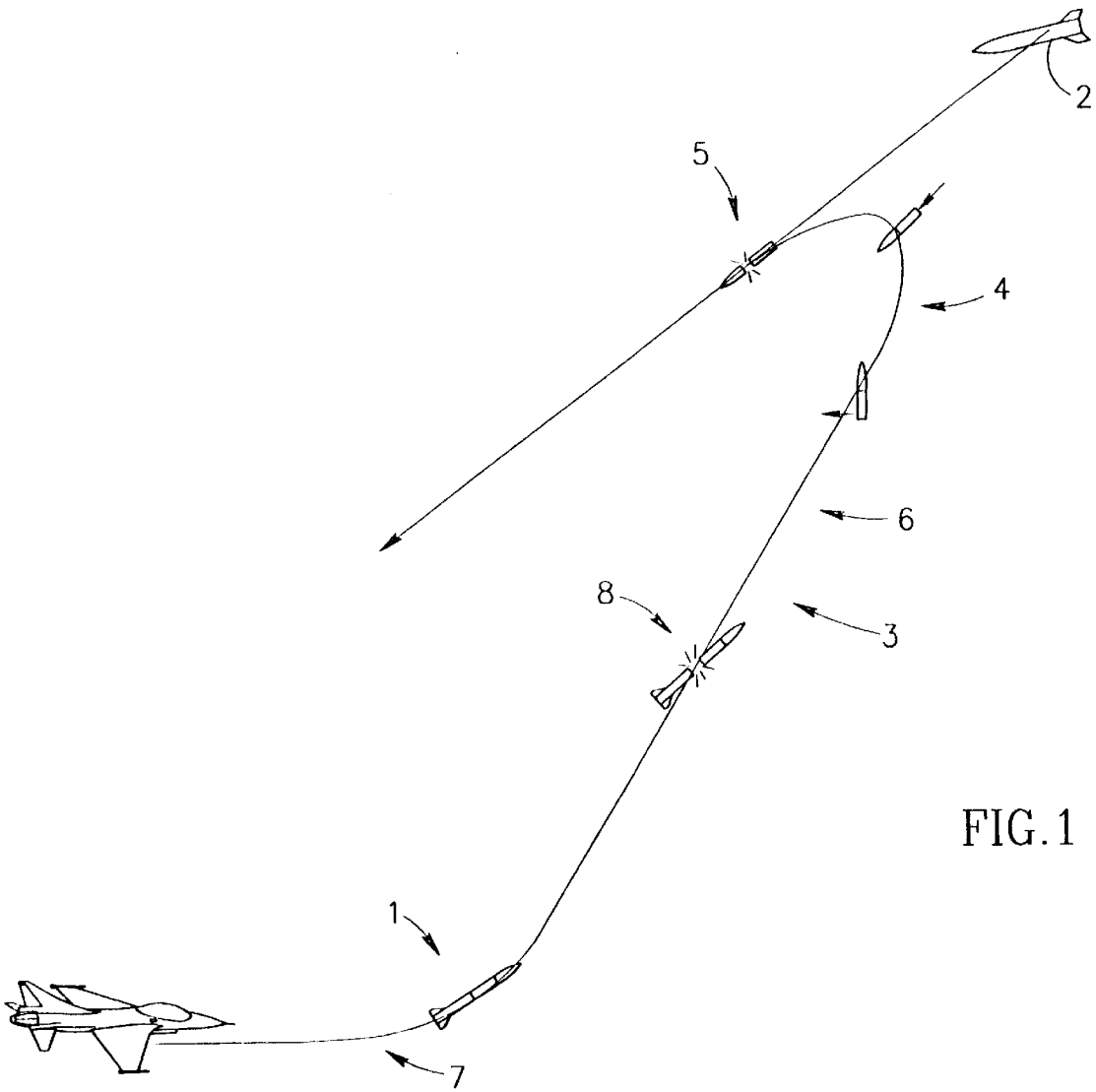
FIG. 1 illustrates graphically the operational stages of an intercepting missile, according to one embodiment of the invention.
Figure 2:
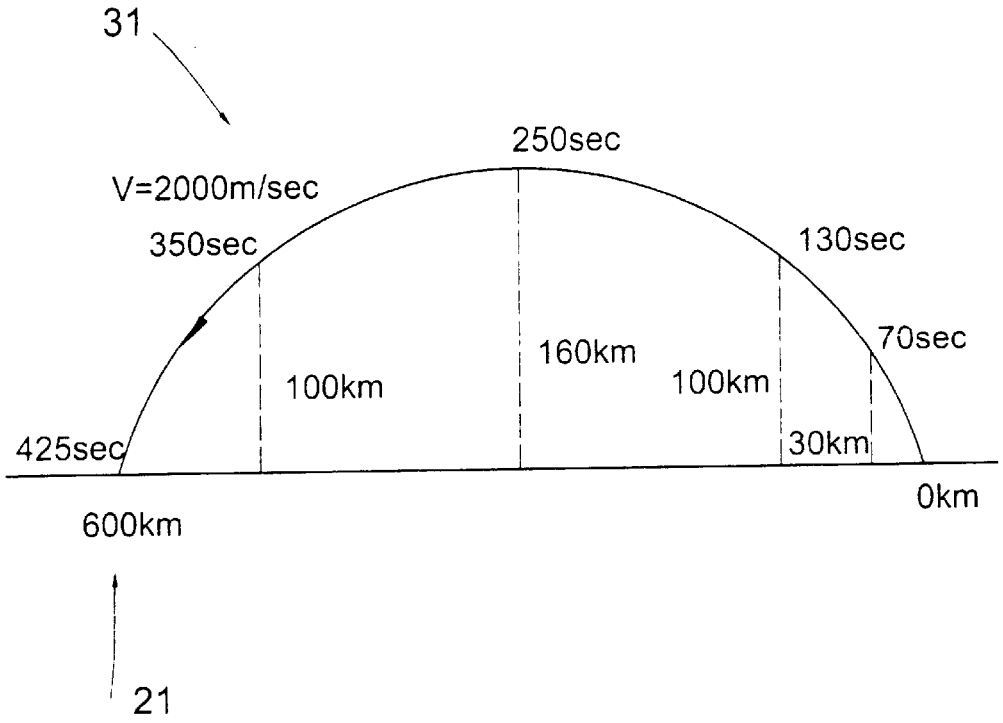
FIG. 2 illustrates, graphically, time and range chart in the interception scenario of FIG. 1.

Attention is first directed to FIGS. 1–2 for describing one possible interception scenario according to the invention. Those versed in the art will readily appreciate that the interception scenario described with reference to FIGS. 1–2 is only one out of many possible variants, and should not be regarded as binding.

Consider, for example, that a TBM, e.g. (the Russian made SCUD missile) is launched from an enemy territory and aims at hitting target at a range of 600 Km, i.e. a site at a friendly territory (21). As shown in FIG. 2, the flight duration from launch to hit is about 425 sec.

Figure 9:
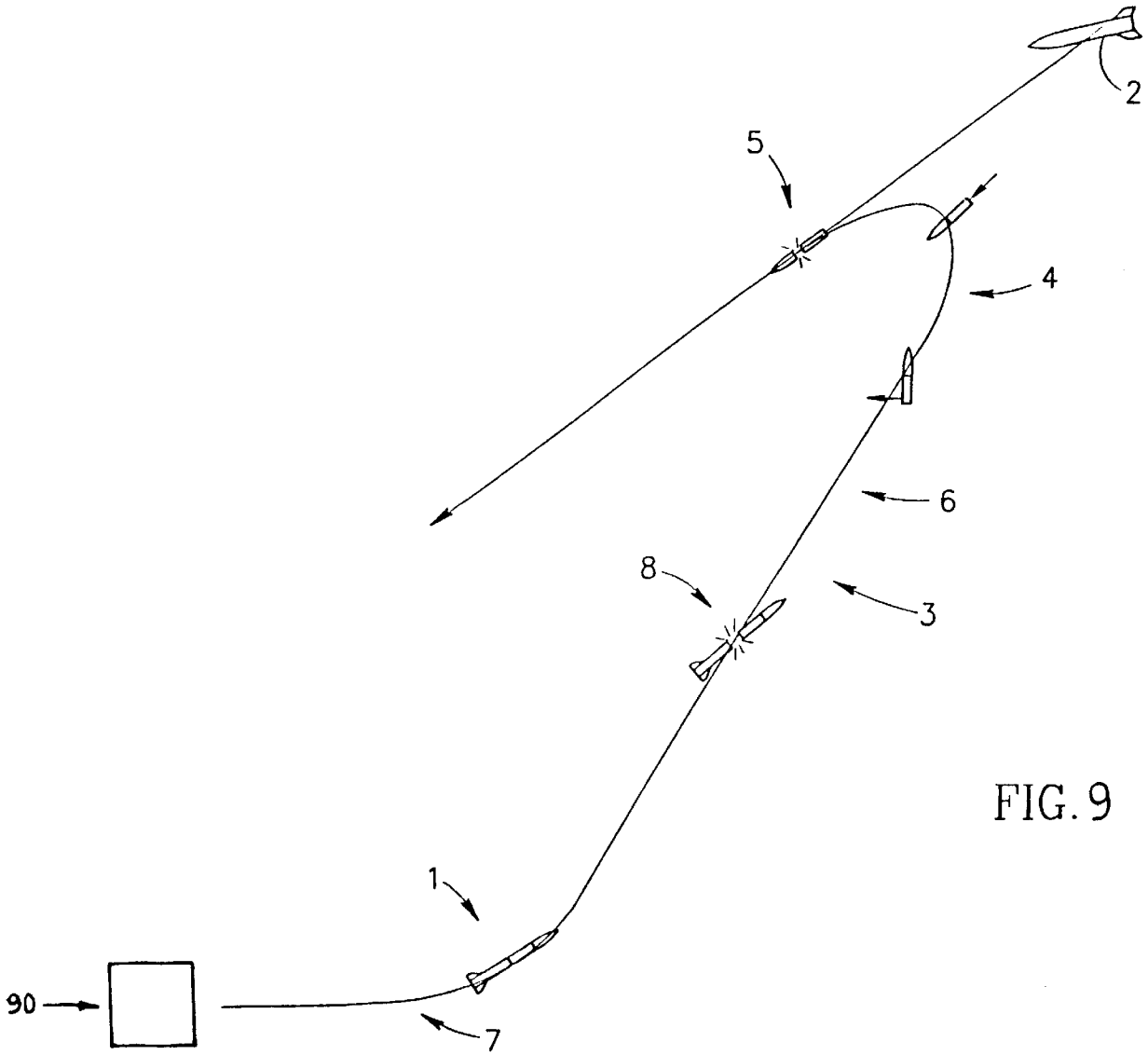
FIG. 9 illustrates graphically the operational stages of an intercepting missile, used with a generalized launch platform.

A combat airplane e.g. an F16 series equipped with one or more interception missiles of the invention loiters over the friendly territory, say at a height of 40,000 feet and at loitering velocity of say 0.7 Mach. The F16 fighter receives an appropriate early warning signal from e.g., a satellite or from an early warning and fire control radar such as EL/M-2080 (commercially available from ELTA Israel) signifying that a target threat has been launched. Other platforms may be used in place of the combat airplane and may include a stationary platform, an air vehicle, a maritime vehicle, a motorized land vehicle, or a space vehicle, as represented by the platform (90) in FIG. 9.

The interception zone (31) is selected to be at an altitude of about 100 Km and at a distance of about 110 Km from the target location, namely 350 seconds after launch and 75 seconds before hit.

In response to detected launch and after having determined the desired location zone, there follows a pre-plan phase where the duration of the flight trajectory of the intercepting missile (as basically depicted in FIG. 1) is predicted.

Having predicted the flight trajectory duration, it is now easy to determine the precise timing in which the intercepting missile should be dropped from the carrying platform (e.g. the specified F16) in order to accomplish successful interception at the interception zone.

Figure 3:
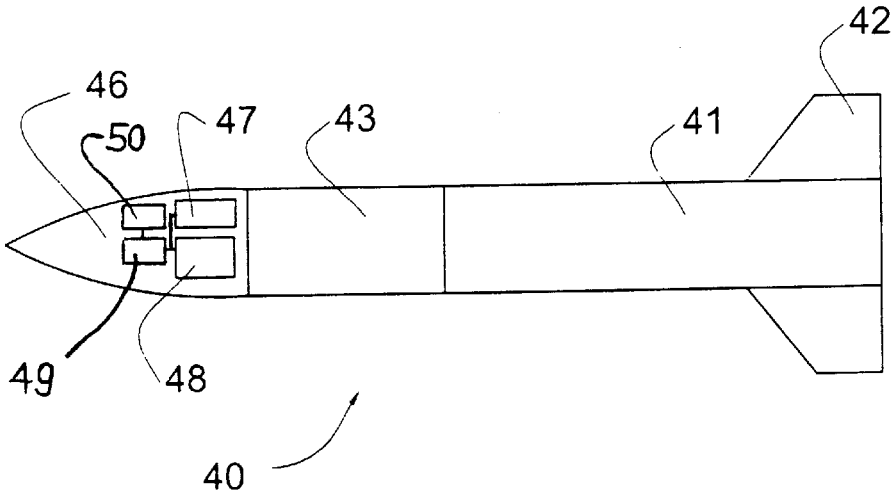
FIG. 3 is a schematic illustration of the various components constituting an intercepting missile, according to one embodiment of the invention.

Before explaining a typical sequence of pre-plan phase, attention is directed to FIG. 3, showing a schematic illustration of the various components constituting an intercepting missile, according to one embodiment of the invention. As shown, missile (40) includes a first stage engine member (41) and its associated steering fins (42). The first stage engine serves basically for the approach flight mode of the intercepting missile ((3) in FIG. 1), where, as recalled, the intercepting missile flies at a high closing velocity towards the target missile.

Module (43) in FIG. 3 is the second stage engine. The second stage serves for steering the missile in the bending trajectory flight mode ((4) in FIG. 1). This flight mode occurs outside the atmosphere and accordingly known per se thrusts are utilized. A non limiting of a first phase engine solid rocket propellant engine as is commonly used in any tactical military missiles. A non limiting example for the second stage engine being a liquid propellant engine where the thrust can be controlled.

Figure 8:
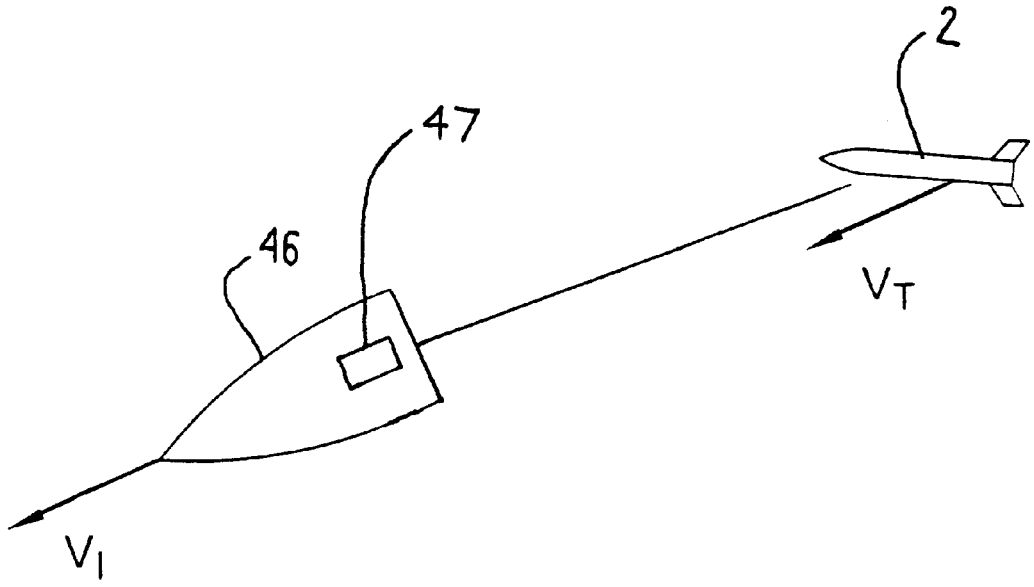
FIG. 8 illustrates a seeker, of the embodiments, which is oriented in a direction opposite a direction of motion of the interceptor.

Also shown in FIG. 3, is a third stage (46), which is basically active at the trajectory matching flight mode (5 in FIG. 1) and the subsequent end-game mode of operation. The third stage 46 includes a seeker unit 47, a destruction capability system 48, a processor 49 and a data link 50 for communication at least with the platform. Seeker unit 47 (FIG. 3) aims at acquiring and tracking the target missile in the end game mode and the thrusts serve for effecting corrections in the flight trajectory of the interception missile in order to bring the interceptor missile to optimal or essentially optimal location vis-a-vis the target TBM, when the target destruction capability system 48 is activated. It should be noted that the third stage is equipped with a controllable propulsion system that generates thrust to control the displacement and attitude of the interceptor vis-a-vis the target. The third stage 46 is shown also in FIG. 8 with seeker unit 47 mounted such that its axis is pointing opposite to the direction of motion $V_I$ of the third stage 46 to observe the target 2 which is approaching along $V_T$ from behind.

Those versed in the art will readily appreciate that the invention is by no means bound by the structure of the missile as depicted in FIG. 3 and accordingly by other embodiments, components may be added, removed and /or modified, all as required and appropriate.

Figure 4:
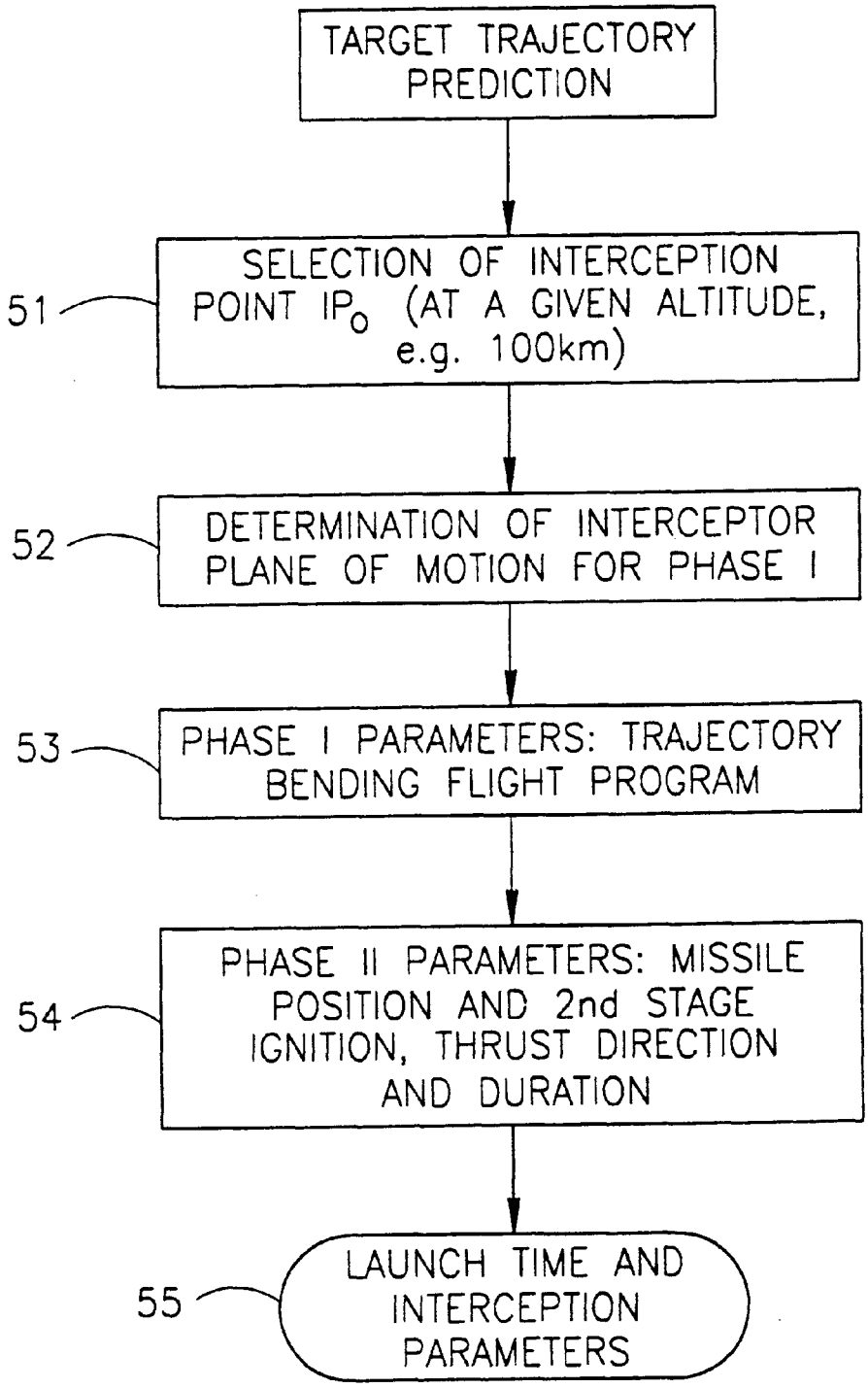
FIG. 4 is a flow chart of typical pre-plan steps for accomplishing target interception.

Having described a general structure of an intercepting missile, attention is now directed to FIG. 4, illustrating a typical, yet not exclusive, sequence of pre-plan phase in order to determine the launch timing of the intercepting missile.

First, the desired interception zone (point) is determined (31 in the example of FIG. 2 and step (51)).

Next, the behavior of the intercepting missile in the approach flight mode, including calculating the interception plane step (52)); calculating the initial bent trajectory where the missile transits from the flight trajectory following launch and starts climbing (1) in FIG. 1 and step (53) in FIG. 4), and other flight program parameters, all as known per se in the general literature that pertains to the basic dynamic principles of missile flight utilizing rocket propulsion.

After having calculated the relevant parameters of the approach flight mode there follows pre-plan calculation of the trajectory bending mode ((4) in FIG. 1).

It should be borne in mind that before reaching the trajectory bending flight mode, the intercepting missile is planned to continue and fly outside the atmosphere along the pre-planned flight trajectory (see (6) in FIG. 1).

Turning now to the pre-plan calculation that pertain to the trajectory bending mode, various parameters are calculated (step (54)) such as initial missile position when the engines (43) are activated, thrust direction and duration so as to accomplish the desired maneuver which will eventually bring about the desired trajectory matching.

The result of the specified pre-plan calculation steps that have just been described in reference to FIG. 4, is that, amongst the other, the predicted flight duration of the interception missile is obtained. Now, considering that the desired interception point is known, and the so obtained predicted flight duration of the intercepting missile, the processor 49 of the system of the invention is capable of calculating the optimal launch timing of the intercepting missile (from the carrying platform), in order to accomplish the desired interception.

Obviously, the pre-plan program does not necessary apply to real-life scenario, and various parameters may affect the theoretical pre-plan and change the flight behavior of the intercepting missile (as compared to the predicted trajectory), such as target prediction errors, un-modeled interceptor dynamics, measurements errors, and others. Accordingly, the system of the invention preferably employs capabilities to correct the behavior of the intercepting missile while on-flight in order to assure successful interception.

Figure 5:
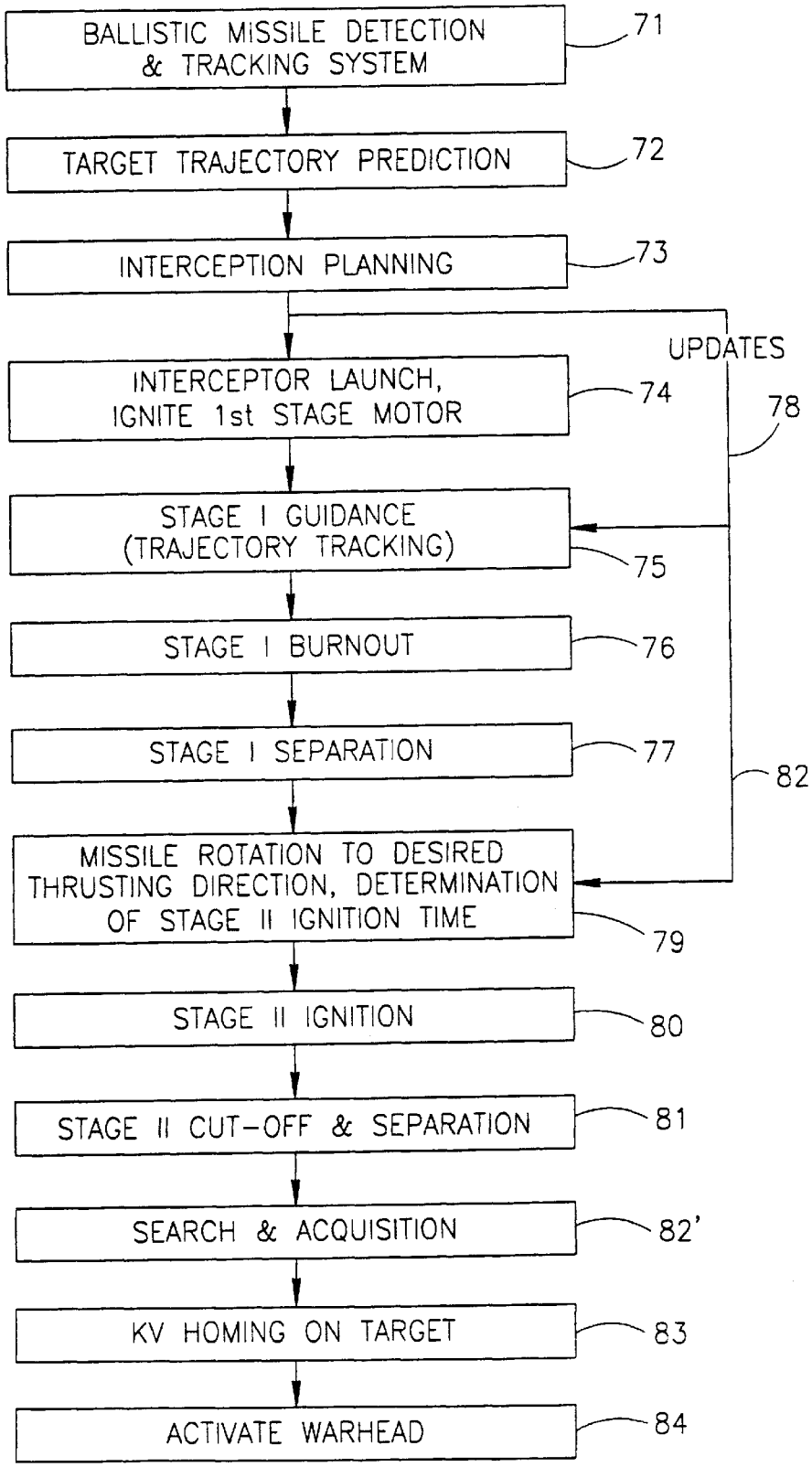
FIG. 5 is a flow chart of typical steps performed in an actual interception scenario.

Attention is now directed to FIG. 5 showing a flow chart of typical, yet not exclusive, steps performed in an actual interception scenario. Thus, at a first stage (71), the early warning system (e.g. the specified EL/M 2080 radar system) alerts on launched TBM. The early warning system is also capable of predicting the flight trajectory of the threat TBM (72). Next, there follows an interception planning phase (73) of the kind described with reference to FIG. 4. The pre-planning calculation takes, of course, into account the predicted flight trajectory of the threat as obtained in step (72).

Next (step 74), the intercepting missile is launched at the launching timing that is derived from the previously calculated interception planning and the various operations that pertain to the approach mode are performed including ignition of stage I engine (74), bending the flight trajectory (see (7) in FIG. 1), engine I burn-out and engine I separation (steps 75 to 77; and (8) in FIG. 1). During the entire approach mode interception parameters are modified according to updated information about the target (78), thus allowing to work in an essentially closed-loop feedback. Corrective maneuvers may be performed as long as the missile exhibits maneuvering capability (during engine operation and after burn out if the missile is provided with aerodynamic controls).

The trajectory bending is preceded by a ballistic arc which brings the missile to the second flight phase where the second engine is ignited and then cut-off and separated so as to bring the interception missile to the desired trajectory (steps 79, 80 and 81). As before, parameter updates can be transmitted to the missile based on the most recent target data. (82) Having been located ahead of the target missile and at a relatively small closing velocity (5 in FIG. 1), there commences the end-game mode, where the seeker unit of the intercepting missile searches and acquires the target, and subsequently utilizing the thrusters, the intercepting missile homes onto the target (steps 82' and 83), in a known per se manner. The seeker 47 may be operational during the end game mode and is mounted on the interceptor such that its axis points opposite to the direction of motion of the interceptor to observe the target which is approaching from behind.

What remains to be done is simply to activate the warhead and accomplish the kill (84).

Those versed in the art will readily appreciate that the invention is, by no means, bound by any specific warhead and any known per se means may be utilized. Depending upon the nature of the target destruction capability and on operational constraints, the final kill may be invoked from relatively far distance, in proximity to the target, or by colliding the target.

Figure 6:
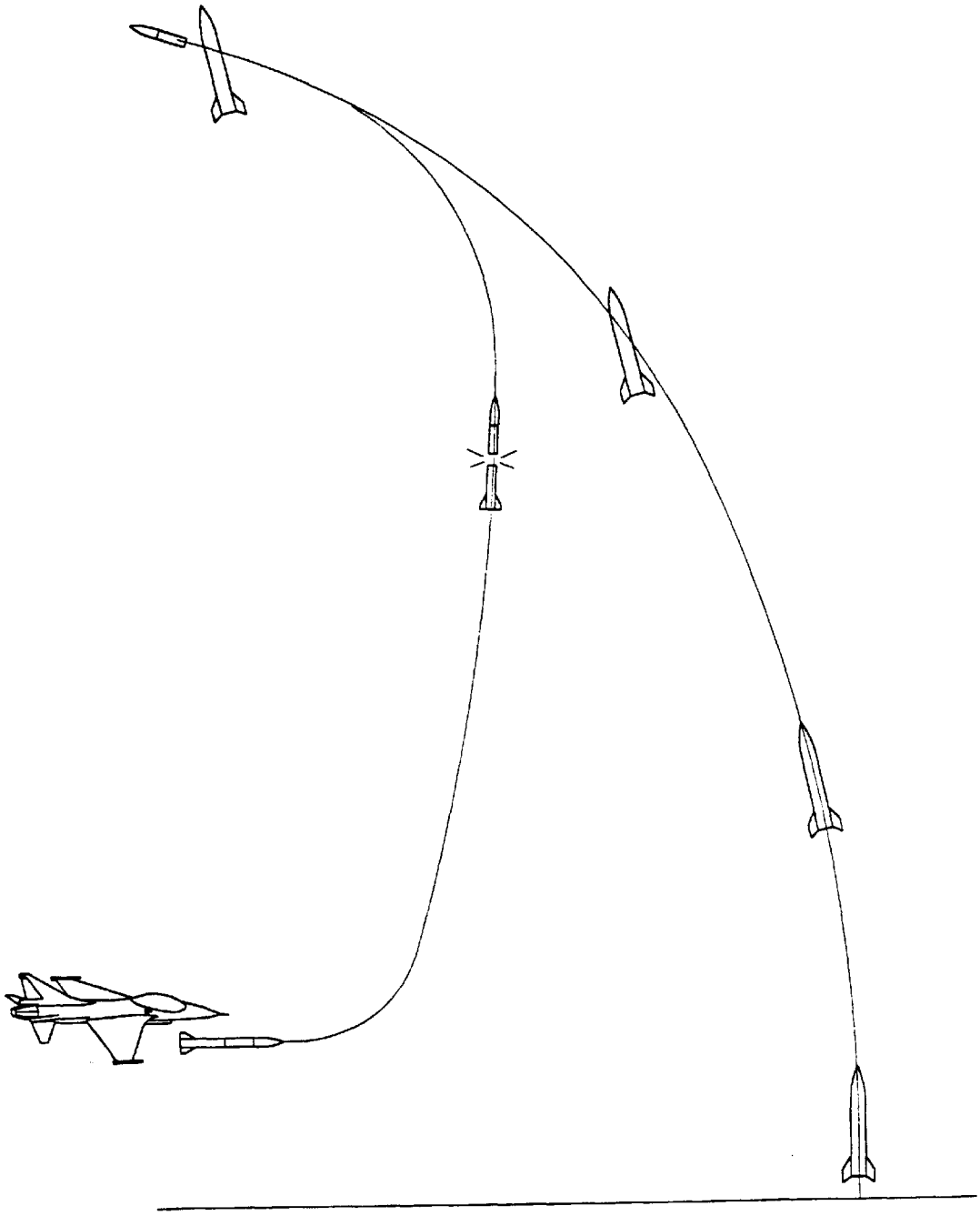
FIG. 6 illustrates, graphically, an exemplary target interception scenario, according to another embodiment of the invention.
Figure 7:
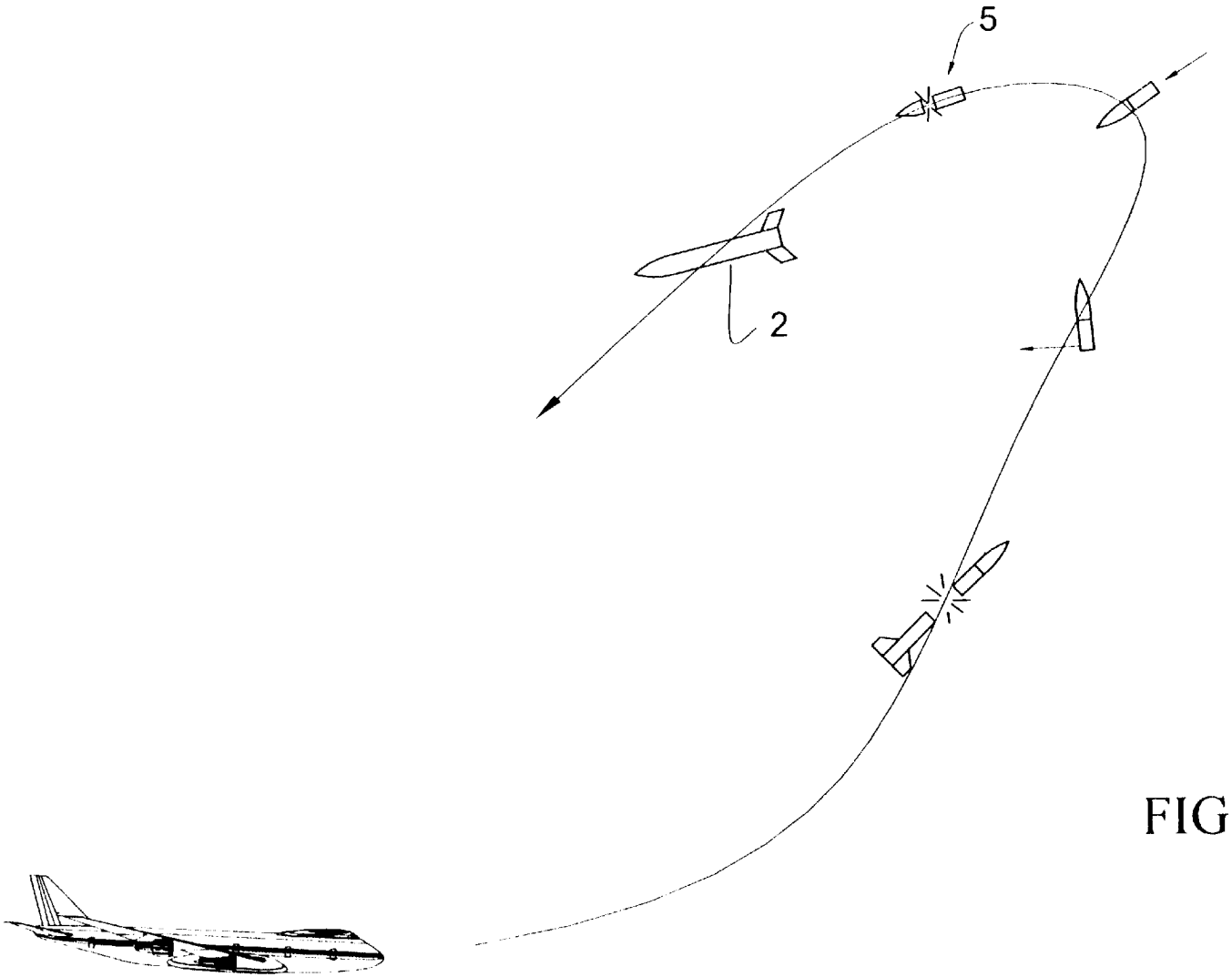
FIG. 7 illustrates, graphically, another exemplary target scenario.

The invention may be utilized in numerous interception scenarios. Another non-limiting example is illustrated in FIG. 6 where the target TBM is intercepted in the post-boost phase, or by yet another example where the scenario of FIG. 1 applies, however the interceptor is placed behind the target and moves faster whilst retaining the small closing velocity constraints (not shown). The various flight mode parameters (e.g., the timing and location where each of the steps (1–8 in FIG. 1)) takes place, may be modified, all as required and appropriate depending, inter alia, on the nature of the target TBM, and the intercept missile. Other steps may be added, all as required and appropriate.

The present invention has been described with a certain degree of particularity, but those versed in the art will readily appreciate that various modifications and alterations may be carried out without departing from the scope of the following claims:

What is claimed is:

1. A system for intercepting targets having predictable flight trajectory, comprising:

(i) a platform carrying at least one interceptor missile; the interceptor missile includes a seeker unit, propulsion system, steering system, and target destruction capability system all communicating with a processor device; said processor device is further coupled to a data link for communicating with at least said platform;

(ii) the processor device, in response to launching of said interceptor missile, for controlling said steering system and propulsion system for steering said missile in at least the following flight modes:

(a) approach mode, wherein said interceptor missile closes on said target;

(b) trajectory matching mode wherein a velocity vector of the interceptor missile is modified to substantially match a predicted trajectory of the target so that the interceptor missile moves in the same direction as the target in a relatively small closing velocity with respect to the target; and (c) end game mode wherein the interceptor missile is maneuvered to a distance sufficiently close to the target whereby said target destruction capability system will destroy the target on activation.

2. The system according to claim 1, wherein said interceptor missile moves in the direction of the target and is positioned ahead of the target and moves at slower velocity than the target.

3. The interceptor of claim 2, wherein the seeker is operational during the end-game mode and is mounted on the interceptor such that its axis is pointing opposite to the direction of the motion of the interceptor, to observe the target, which is approaching from behind.

4. The system according to claim 2, wherein said processor controls said steering system and said propulsion system and activates said target destruction capability system also on the basis of commands received from said platform or other source.

5. The system according to claim 1, wherein said interceptor missile moves in the direction of the target and is positioned behind the target and moves at faster velocity than the target.

6. The system of claim 1, wherein said processor is further capable of pre-planning the flight trajectory of said interceptor missile in order to determine the time of launch of the interceptor missile, as stipulated in (ii).

7. The system of claim 6, wherein said processor device further communicates through said data-link with an early warning system.

8. The system of claim 6, wherein said pre-planning includes:

selecting an intercepting zone;

determining approach flight mode parameters;

determining trajectory matching mode parameters, to obtain said interception timing.

9. The system of claim 8, wherein said approach flight parameters include: interception plane, initial trajectory bending.

10. The system according to claim 8, wherein said trajectory matching flight parameters include: initial missile position, thrust duration and thrust direction.

11. The system according to claim 1, wherein the target having predictable flight trajectory being a ballistic missile (BM).

12. The system according to claim 1, wherein said platform being a stationary platform.

13. The system according to claim 1, wherein said platform being an air vehicle.

14. The system according to claim 1, wherein said platform being a maritime vehicle.

15. The system according to claim 1, wherein said platform being a motorized land vehicle.

16. The system according to claim 1, wherein said platform being a space vehicle.

17. The system according to claim 1, wherein the processor device is configured to modify interception parameters during said modes in a closed loop fashion according to updated information about the target.

18. An intercepting missile including:

(i) a seeker unit, propulsion system, steering system and destruction capability system all communicating with a processor device; said processor device is further coupled to a data link for communicating with at least said platform;

(ii) the processor device, in response to launching of said intercepting missile, for controlling said steering system and propulsion system for steering said missile in at least the following flight modes:

(a) approach mode, wherein said missile closes on a target;

(b) trajectory matching mode wherein a velocity vector of the missile is modified to bring a trajectory of the missile to substantially match a predicted trajectory of the target so that the missile moves in the same direction as the target in a relatively small closing velocity with respect to the target; and (c) end game mode wherein the missile is maneuvered to a distance sufficiently close to the target whereby said target destruction capability system will destroy the target upon activation.

* * * * *